US007484741B2

(12) United States Patent
Kay, III

(10) Patent No.: US 7,484,741 B2
(45) Date of Patent: Feb. 3, 2009

(54) AXLE ASSEMBLY FOR SKATEBOARD

(76) Inventor: John F. Kay, III, 40200 Paseo Serano, Temecula, CA (US) 92591

( * ) Notice: Subject to any disclaimer, the term of this patent is extended or adjusted under 35 U.S.C. 154(b) by 283 days.

(21) Appl. No.: 11/293,255

(22) Filed: Dec. 5, 2005

(65) Prior Publication Data

US 2007/0126191 A1 Jun. 7, 2007

(51) Int. Cl.
*B62M 1/00* (2006.01)

(52) U.S. Cl. ..... 280/87.042; 280/87.01; 280/87.03; 280/87.041

(58) Field of Classification Search ..... 280/11.28, 280/87.01, 87.021, 87.03, 87.041, 87.042
See application file for complete search history.

(56) References Cited

U.S. PATENT DOCUMENTS

| | | | | |
|---|---|---|---|---|
| 3,331,612 | A | 7/1967 | Tietge | |
| 3,389,922 | A | 6/1968 | Eastin | |
| 3,795,409 | A | 3/1974 | Cudmore | |
| 4,135,546 | A | 1/1979 | Morrison | |
| 4,150,838 | A | 4/1979 | Lappage | |
| 5,551,717 | A * | 9/1996 | De Courcey Milne | 280/87.042 |
| 5,794,955 | A | 8/1998 | Flynn | |
| 6,254,113 | B1 | 7/2001 | Dornan | |
| 6,367,819 | B1 * | 4/2002 | Andersen et al. | 280/11.28 |
| 6,398,237 | B1 | 6/2002 | Attey | |
| 6,669,215 | B2 | 12/2003 | Laporte | |
| 7,226,063 | B2 * | 6/2007 | Paddock | 280/87.042 |

* cited by examiner

*Primary Examiner*—Christopher P Ellis
*Assistant Examiner*—Katy Meyer
(74) *Attorney, Agent, or Firm*—Birch, Stewart, Kolasch & Birch, LLP

(57) ABSTRACT

A top-mounted, wide-track axle assembly for a skateboard. The axle assembly includes an axle frame member having a length of at least eight inches and formed substantially in a shape of an inverted "W". A central portion of the axle frame member is provided with a mounting bracket having a downwardly projecting pin and a slot-shaped hole for pivotably and tiltably mounting the axle frame member on a top surface of the skateboard in a direction perpendicular to a traveling direction of the skateboard. Outer arm portions are provided on opposite ends of the axle frame member for accommodating a pair of right and left wheels outboard of side edges of the skateboard.

15 Claims, 9 Drawing Sheets

AXLE ASSEMBLY FOR SKATEBOARD

BACKGROUND OF THE INVENTION

1. Field of the Invention

The present invention relates to an axle assembly for a skateboard. In particular, the present invention relates to a top-mounted, wide-track axle assembly that, when mounted on a skateboard, makes learning to use the skateboard easier, and provides improved stability and improved handling while riding on the skateboard.

2. Description of Background Art

A conventional axle assembly for a skateboard is mounted on a base attached on a bottom side of a skateboard. An axle mounting portion for holding an axle for a mounting a pair wheels is movably attached to a post projecting downward from the base. The pair of wheels are right and left wheels, and typically mounted on ends of a single axle and are spaced apart by four (4) to six (6) inches. Thus, the wheels are positioned under the skateboard.

The axle mounting portion is capable of moving in a rocking manner about the post from side-to-side by a first predetermined amount, and also is capable of rotating about an axis of the post by a second predetermined amount. Assuming the wheels are 50 to 70 mm (2 to 3 inches) in diameter, the bottom of the skateboard must be at least three (3) or four (4) inches above the traveling surface so that clearance remains between the skateboard and wheels when the skateboard tilts during turning. With larger wheels, the bottom of the skateboard must be even higher above the traveling surface. Thus, it is common for a skateboard deck to be four (4) to six (6) inches above the traveling surface. Due to the height of the skateboard deck above the traveling surface, and the relatively narrow track of the wheels, learning to use a skateboard with a conventional axle assembly is difficult. In addition, a skateboard with a conventional axle assembly is less stable and more difficult than is desirable for riders of all experience levels.

SUMMARY AND OBJECTS OF THE INVENTION

The present invention was developed to address these and other problems of the skateboard axle assemblies of the conventional art.

According to one aspect of the present invention, an axle assembly for a skateboard includes an axle frame member having a length of at least eight inches and formed substantially in a shape of an inverted "W", wherein a central portion of the axle frame member is provided with a mounting bracket having a downwardly projecting pin and a slot-shaped hole for pivotably mounting the axle frame member on a top surface of the skateboard in a direction perpendicular to a traveling direction of the skateboard, and wherein outer arm portions are provided on opposite ends of the axle frame member for accommodating a pair of right and left wheels outboard of side edges of the skateboard.

According to a another aspect of the present invention, the axle frame member includes two central arm portions extending upwardly and outwardly, respectively, in a right and a left direction from the central portion of the axle frame member, the outboard arm portions extend, respectively, in a downward direction from ends of the central arm portions; and cylindrical-shaped axle mounting portions integrally formed on ends of the outboard arm portions, each of the cylindrical-shaped axle mounting portions having a hole for accommodating an axle for the wheels.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
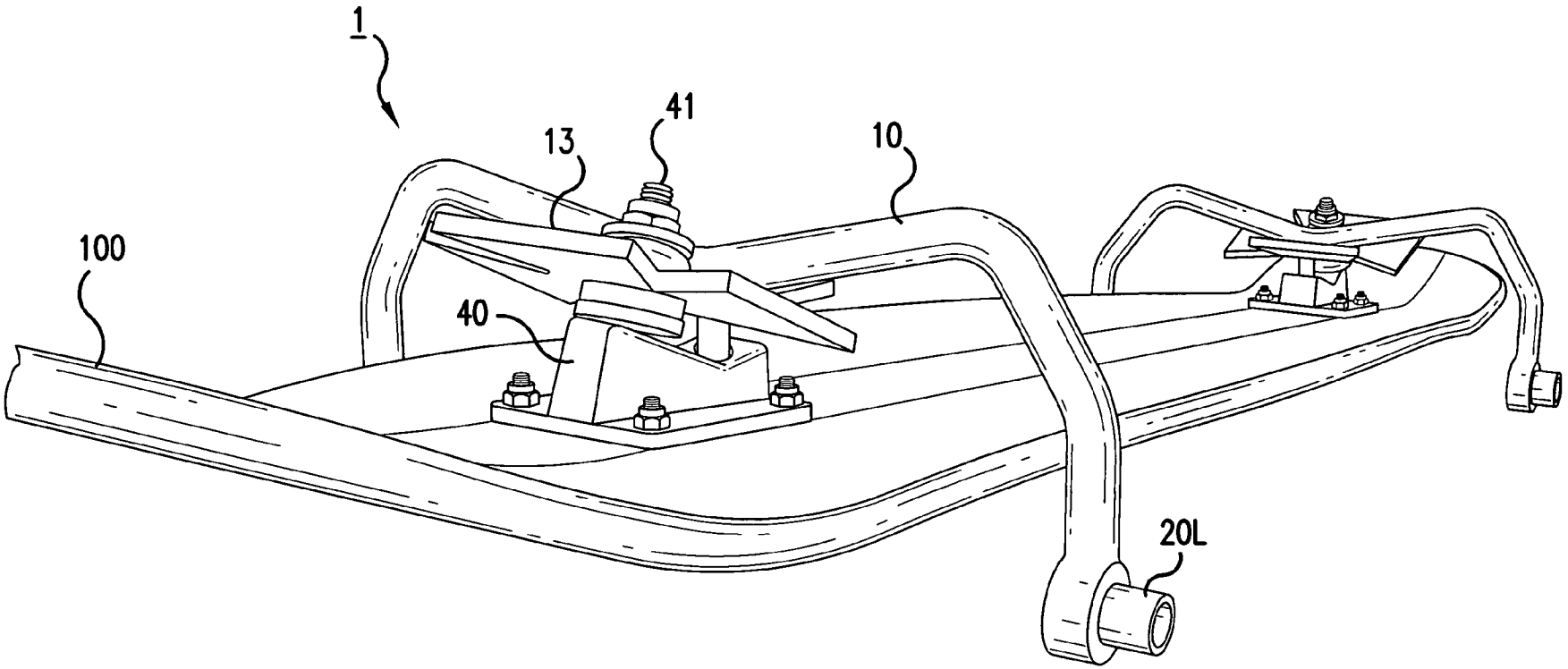
FIG. 1 is a perspective view of the axle assembly of one embodiment of the present invention mounted on a front portion and a rear portion of a skateboard.
Figure 2:
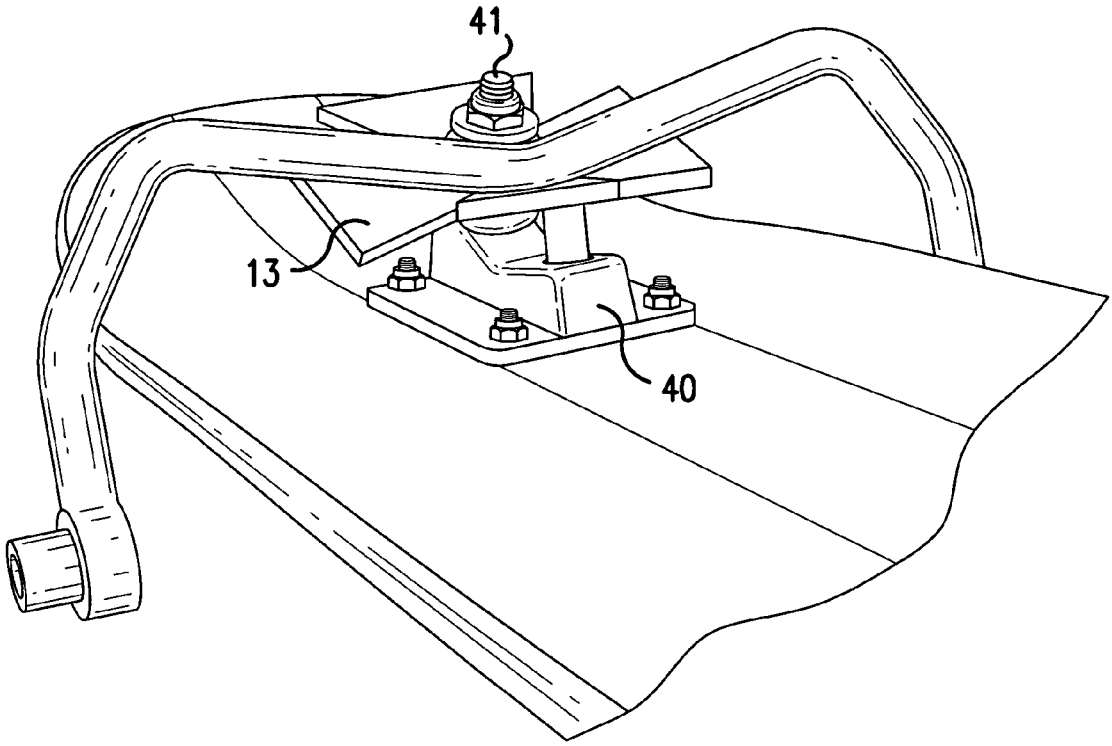
FIG. 2 is a rear perspective view of the axle assembly of one embodiment of the present invention mounted on a front portion of a skateboard.
Figure 3:
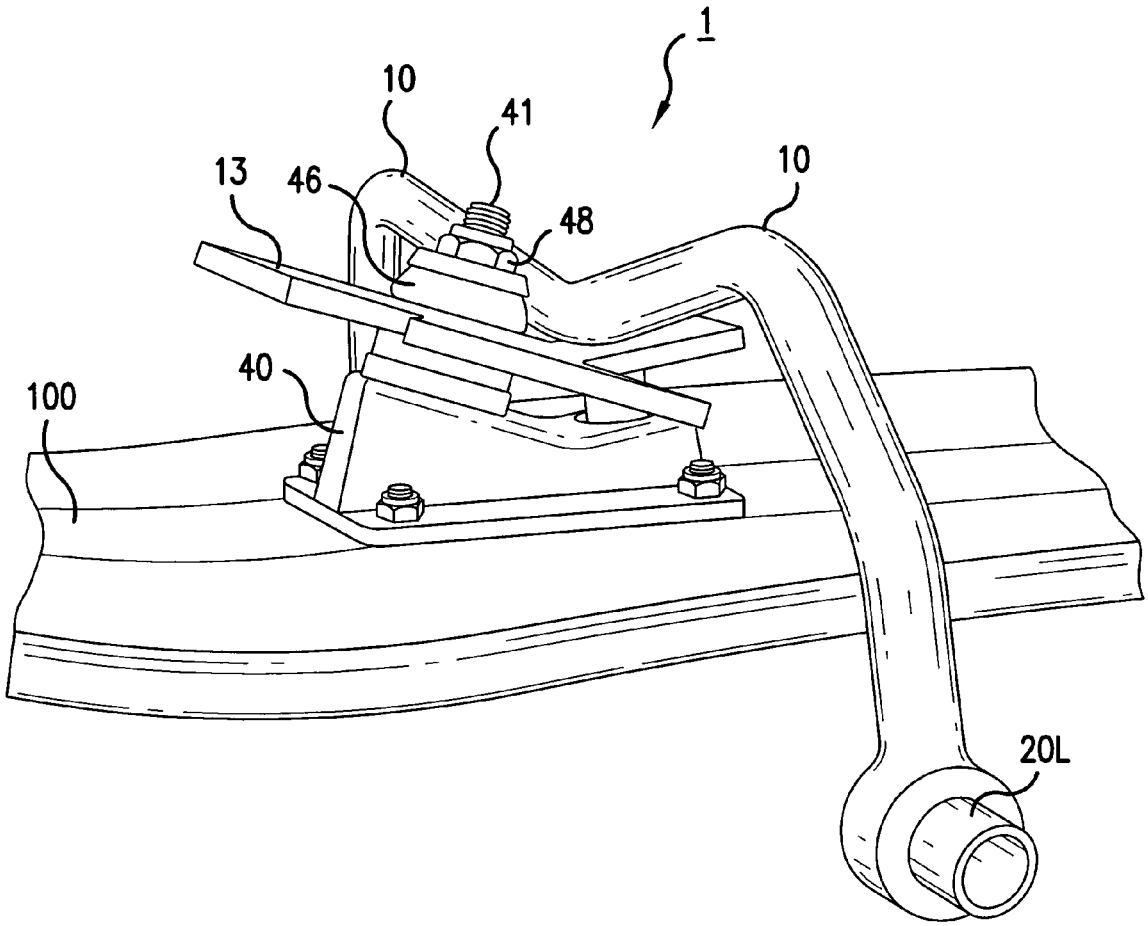
FIG. 3 is a side perspective view of the axle assembly of one embodiment of the present invention mounted on a front portion of a skateboard.

FIG. 1-3 are perspective views of the top-mounted axle assembly 1 of one embodiment of the present invention mounted on a front portion and a rear portion of a skateboard. A mounting base 40 is attached to a top surface of the skateboard 100 by means four bolts of a conventional type. An axle frame member 10 formed of a rigid metal shaft formed substantially in the shape of an inverted "W" is movably attached to a shaft 41 extending upwardly from the mounting base 40. Axle mounting portions 20 are provided on each end of the axle frame member 10. An axle holding a wheel (WR or WL, as shown in FIG. 5) is mounted on each of the axle mounting portions 20 R, L.

Figure 5:
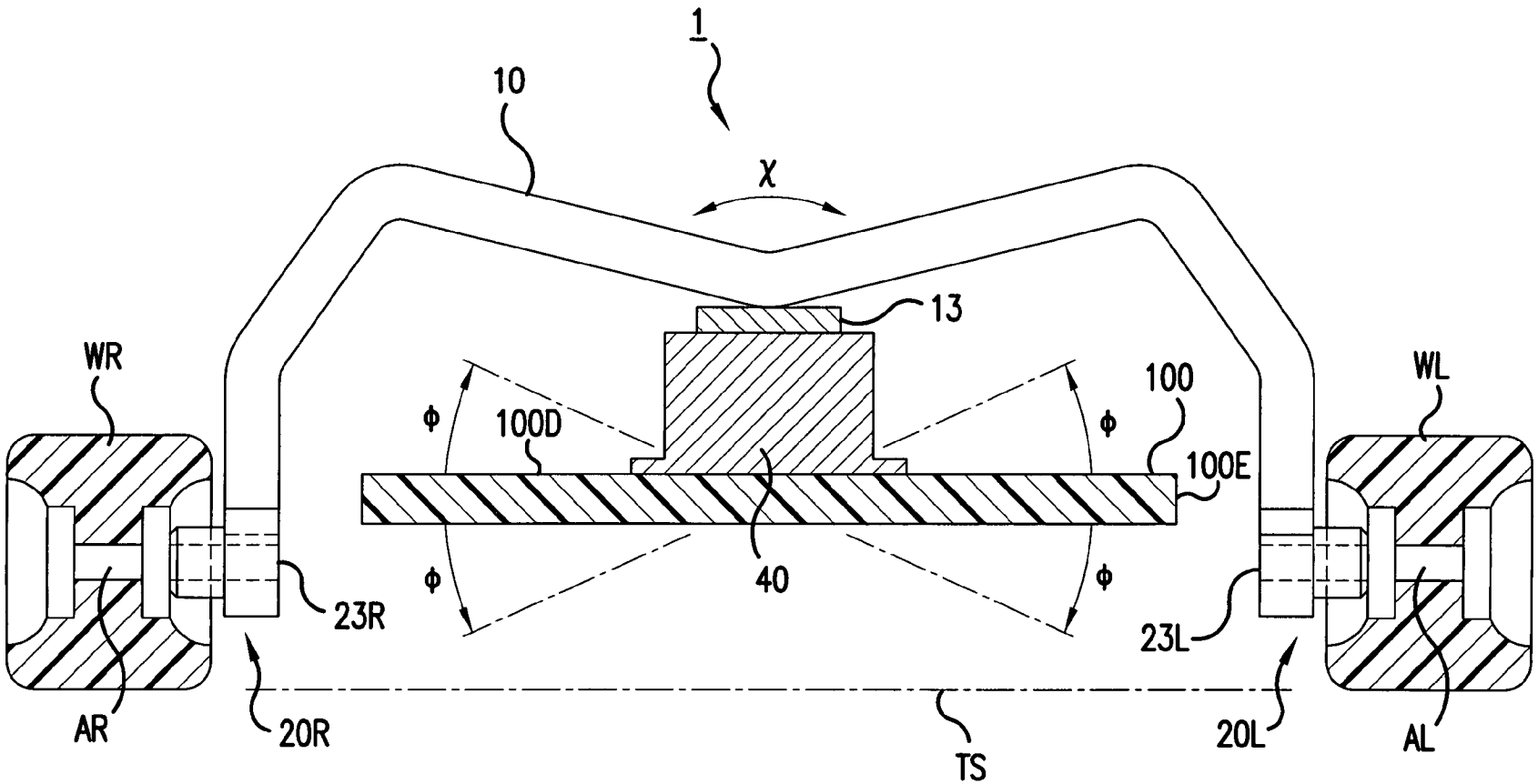
FIG. 5 is a schematic showing a cross-sectional view of the axle assembly of one embodiment of the present invention taken in the direction of arrows A-A of FIG. 4, with wheels mounted on the axle assembly.

The wheels (WR, WL, as shown in FIG. 5) are in the range of eight (8) to fourteen (14) inches apart, depending of the width of the skateboard 100. As shown in the FIGS., the top-mounted axle assembly 10 allows the deck of the skateboard 100 to be lower than with conventional bottom-mounted axle assemblies, thus making the skateboard easier to ride, as well as changing the "feel" of the ride. Experimental testing has shown that a skateboard with a top-mounted axle assembly feels like riding a wakeboard, a board towed behind a boat. The wide wheel stance gives the skateboard more stability. The wheels preferably are measured in millimeters and the desired size is in a range of 50 mm to 100 mm (approximately 2 to 4 inches). Larger wheels, say five (5) inches in diameter, may be used, so long as do not get in the way of the rider's feet when riding. Standard skateboard wheels are 70 mm (2.75 inches) and up, and all can be used with the axle assembly of the present invention. FIG. 3 shows a side perspective view of the axle assembly 1 mounted on the front of the skateboard 100. FIG. 3 also shows mount base 40, and nut 48 securing the axle frame member 10 and the bracket 13 onto shaft 41 by means of nut 48. An elastic member (rubber bushing) 46 is disposed between nut 48 and bracket 13, allowing the axle frame member 10 to tilt from side-to-side by a first predetermined amount and to rotate by a second predetermined amount in a horizontal plane, as will be discussed in further detail below.

Figure 4:
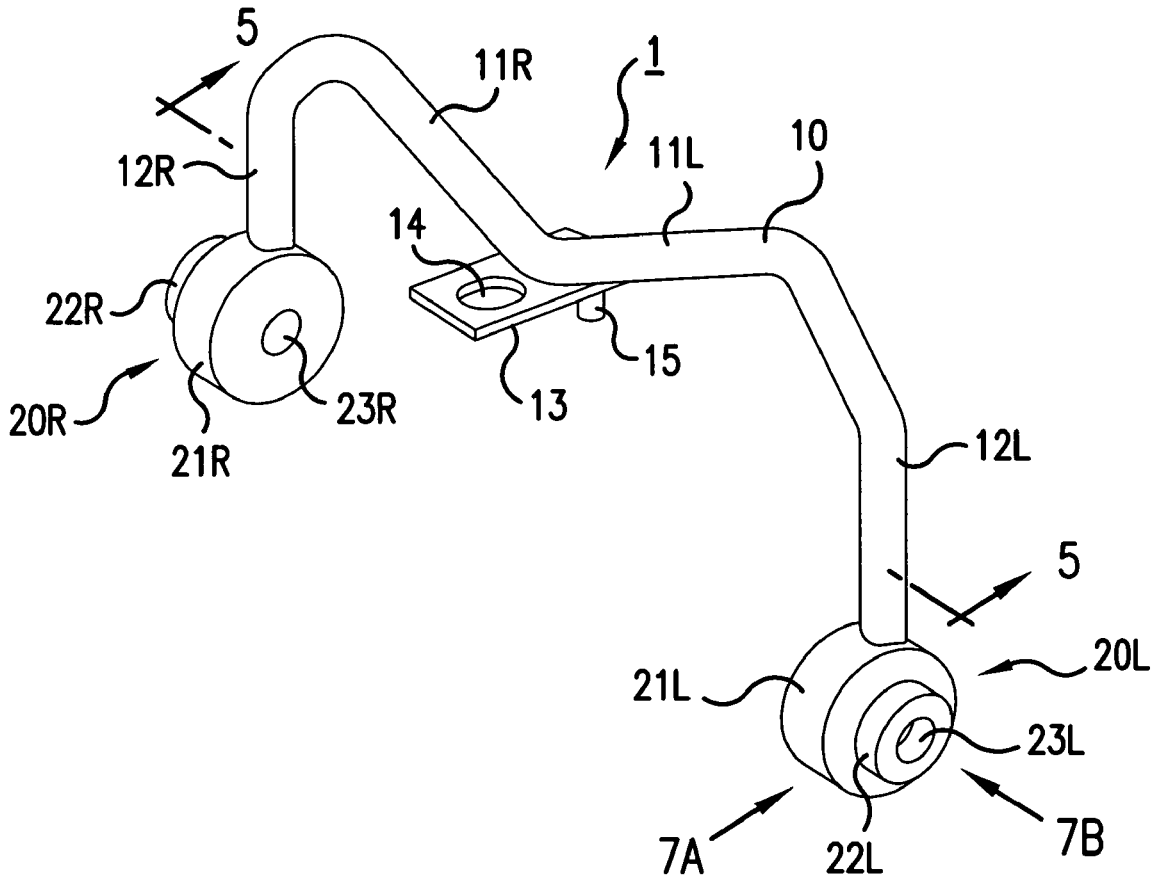
FIG. 4 is a schematic showing a perspective view of the axle assembly of one embodiment of the present invention.
Figure 9:
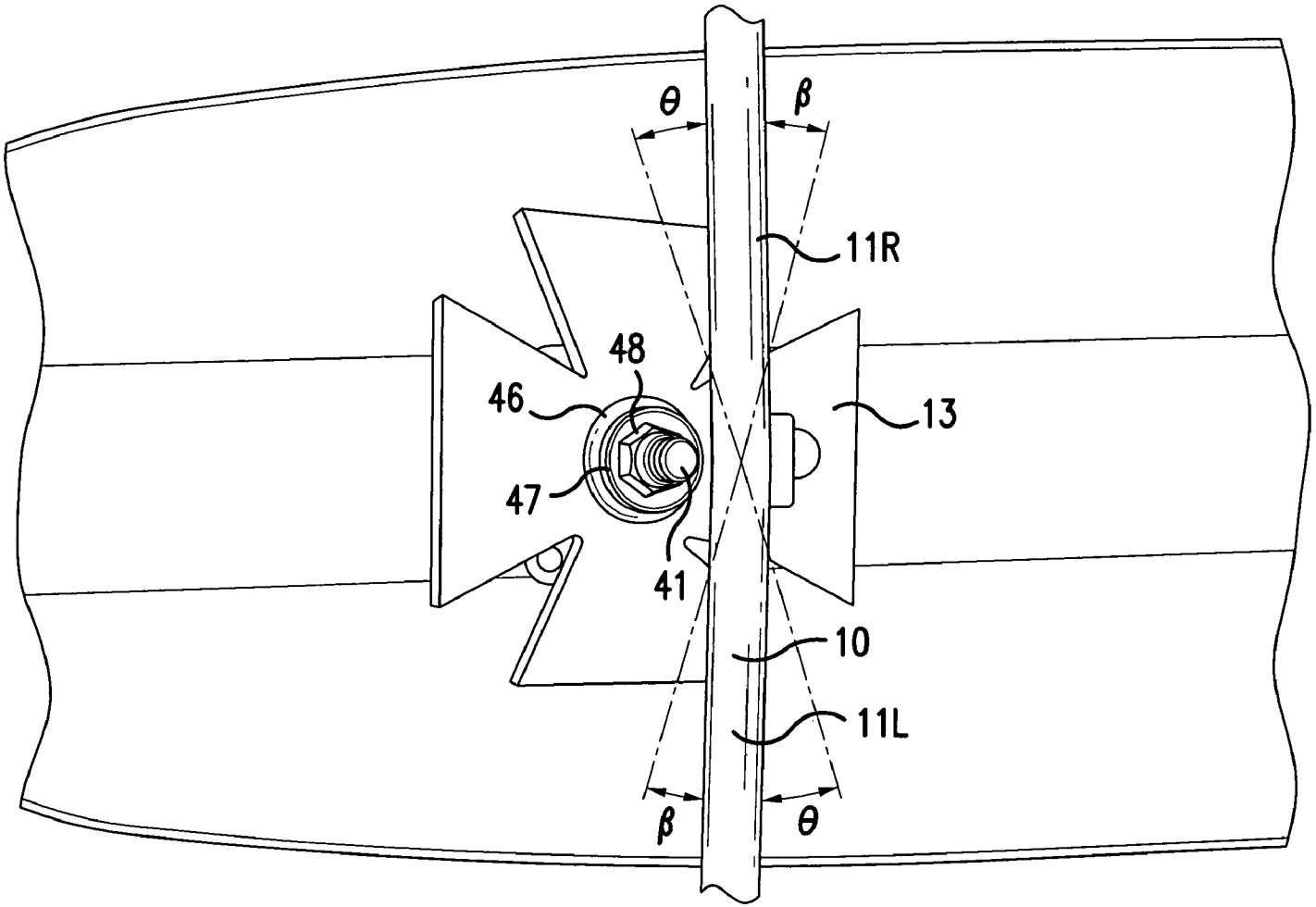
FIG. 9 is a top down view of a central portion of the axle assembly of one embodiment of the present invention showing the central arm portion of the axle assembly mounted on the upward projecting shaft of the mounting base.

FIG. 4 is a schematic showing a perspective view of the axle frame member 10 and the axle mounting portions 20R, L. As can be seen, axle frame member 10 includes right and left central arm portions 11R, L, each extending outwardly and upwardly from a middle of the axle frame member and join to form a "V" having an obtuse angle $\chi$. Also shown are right and left outboard arm portions 12R, L, central mounting bracket 13, oversized slot hole 14, and mounting pin 15. Slot hole 14 is larger than the diameter of shaft 41, so that the axle frame member 10 can tilt and rotate by predetermined amounts relative to the shaft 41. As can be seen, the central arm portions 11R, L and outboard arm portions 12R, L of the axle frame member 10 are arranged in the shape of an inverted "W". The bracket 13 may be substantially rectangular in shape as shown in FIG. 4. Alternatively, bracket 13 may have a stylistic shape, for example, the "cross-shaped" bracket 13 as shown in FIG. 9, or any other shape. The slot hole 14 and mounting pin 15 allow the trucks (axle 10 and wheels WR, WL) to turn and the skateboard 100 to tilt. For example, the mounting pin 15 acts as a pivot point and slot hole 14 allows each truck to rotate while being held to the skateboard 100. This pivot motion is illustrated in FIG. 9, showing angles $\theta$ in a range of 0° to 20°. When turning, the front and rear axle frame members 10 rotate in opposite directions, similar to conventional bottom-mounted axle assemblies.

The right and left axle mounting portions 20R, L include inner cylindrical parts 21R, L, and outer cylindrical parts 22R, L which have diameters smaller than diameters of the inner cylindrical parts 21R, L. Axles holes 23R, L, for accommodating axles (not shown), extend through the axle mounting portions 20R, L.

FIG. 5 is a schematic showing a cross-sectional view of the axle assembly 1 viewed in the direction of arrows 5-5 of FIG. 4. Wheels WR and WL are mounted on the axles AR and AL of the axle mounting portions 20R and 20L. Axles AR and AL are mounted in axle holes 23R and 23 L. With the top-mounted axle assembly 1 of the present invention, the upper surface (deck) 100D of the skateboard 100 may be positioned below the uppermost portion of the wheels WR, WL, in other words, much closer to the traveling surface TS than is possible with conventional bottom-mounted axle assemblies. The angles $\phi$ show the range of 0° to 45° of tilting motion of the skateboard 100 with respect to the axle frame member 10.

Figure 6:
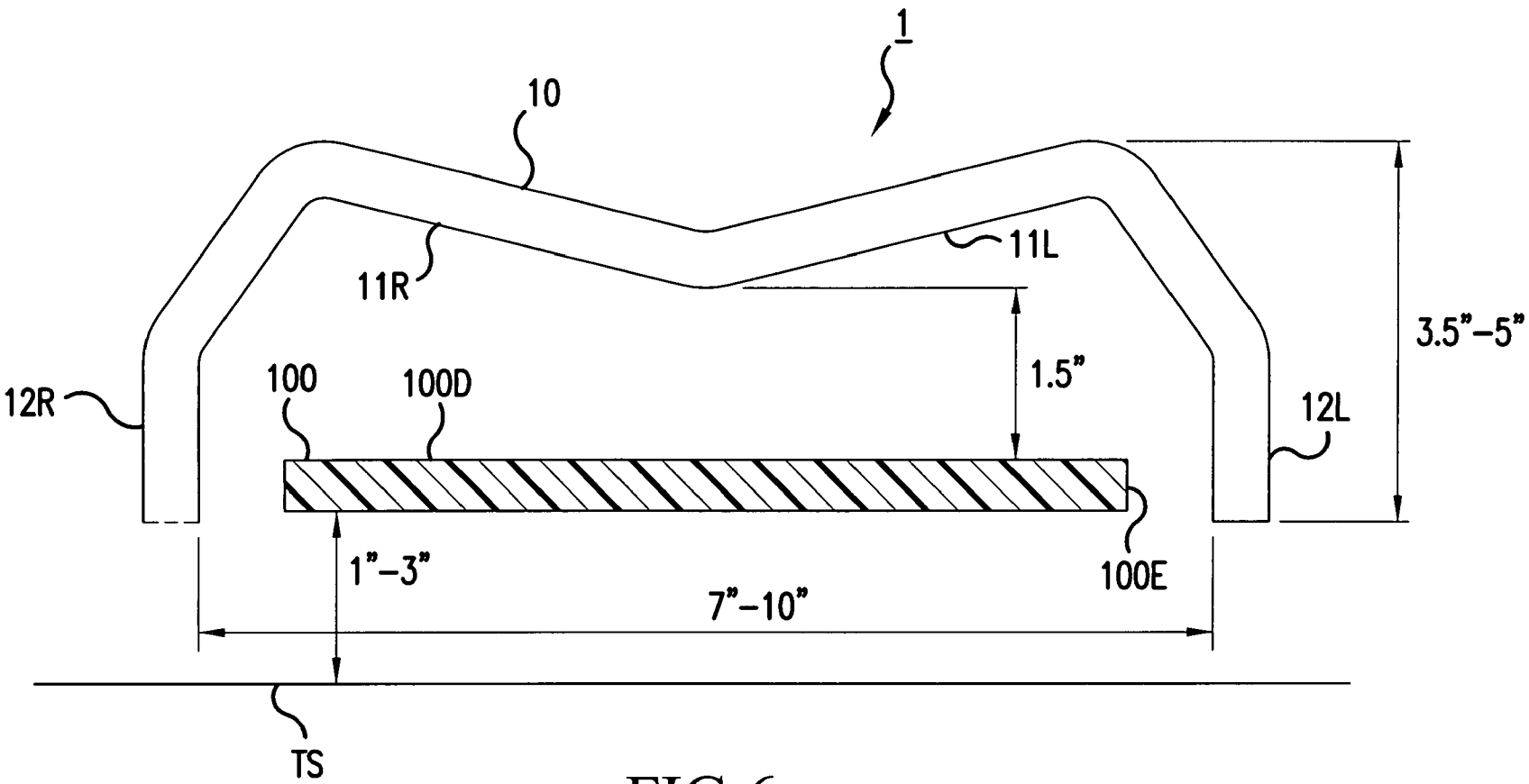
FIG. 6 is a schematic showing a front view of the axle frame of the axle assembly.

FIG. 6 is a schematic showing a front view of the axle frame member 10 of the axle assembly 1, where the inverted "W" shape is evident. The height of the axle frame member 10 may be between three and one half (3.5) and five (5) inches, a distance between inner faces of outboard arm portions 12R, L is generally seven (7) to ten (10) inches, depending on the width of the skateboard 100, and a central portion of the axle frame member 10 is mounted on the mounted base 40 in a position at least one and one half (1.5) inches above the deck 100D of the skateboard 100. The bottom of the skateboard being is generally one and one half (1.5) inches to three (3) inches, above the traveling surface TS. These dimension are set so that when the skateboard 100 tilts and/or the truck (axle frame member 10 and wheels WR, WL) rotates, the deck 100D and the edges 100E of the skateboard 100 do not come in contact with either the central arm portions 11R, L or outboard arm portions 12R, L of the axle frame member 10.

Figure 7A:
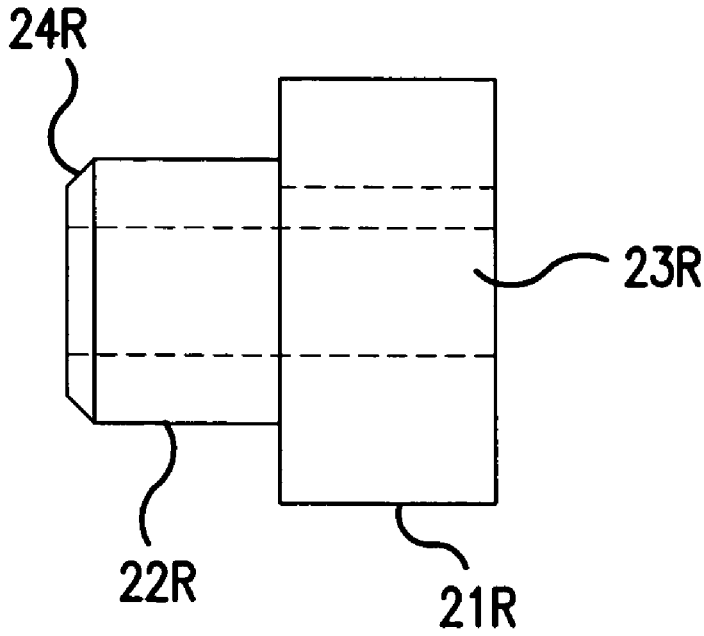
FIGS. 7(*a*) and 7(*b*) are schematics showing side and axial views of the axle mounting portion of the axle assembly, taken in the direction of arrows C and B of FIG. 4, respectively.
Figure 7B:
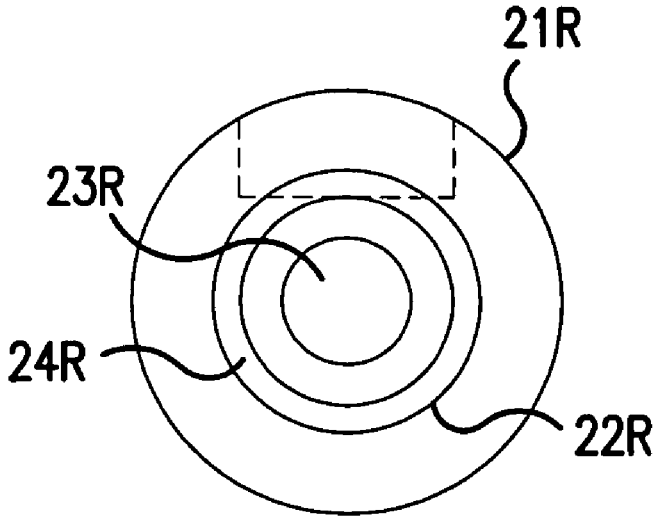

FIGS. 7(*a*) and 7(*b*) are schematics showing side and axial views of the axle mounting portion 20R of the axle assembly 1, taken in the direction of arrows 7A and 7B of FIG. 4, respectively. A chamfer 24R is shown on the outer edge of outer cylindrical portion 22R. (The dotted line at the top of FIG. 7(*b*) represents the lower end of the outboard arm portion 12L.)

Figure 8:
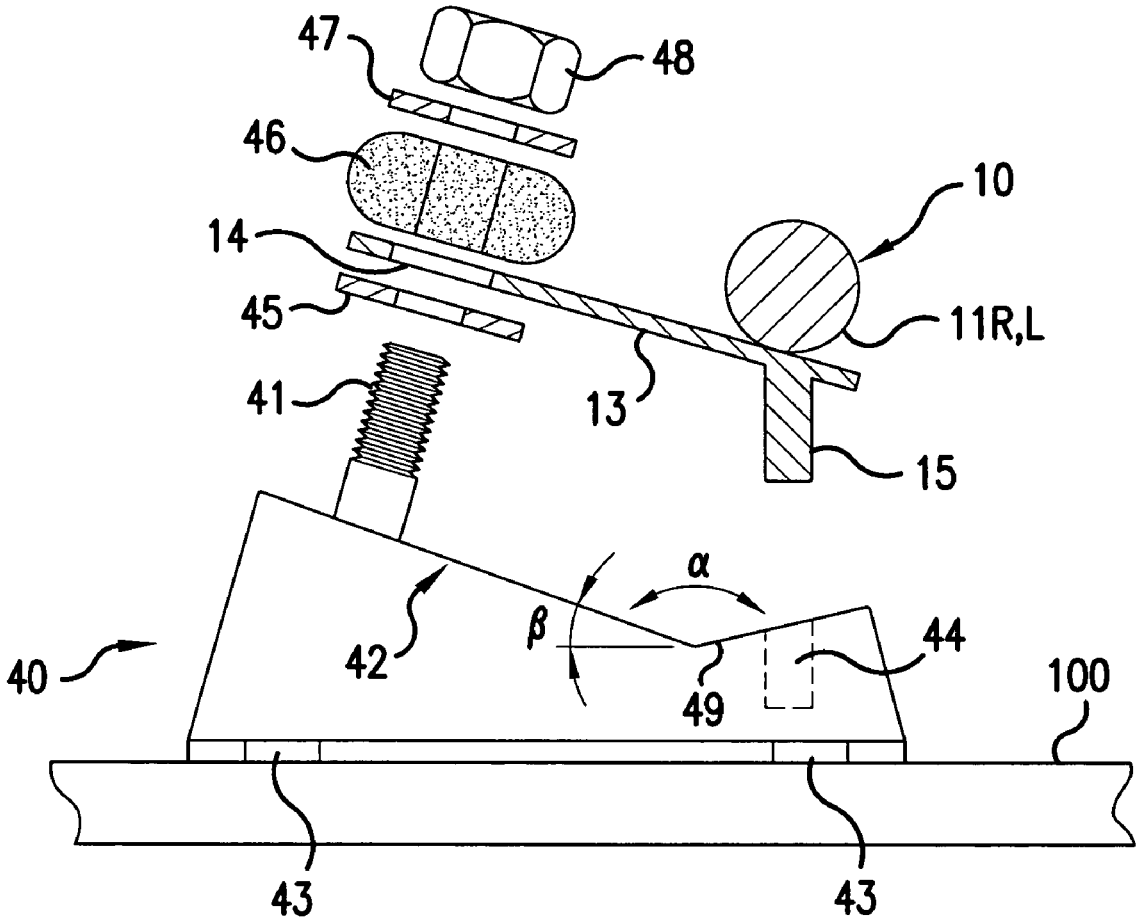
FIG. 8 is schematic showing an exploded sectional side view of the mounting base and mounting components of the axle assembly of the present invention.

FIG. 8 is schematic showing an exploded sectional side view of the mounting base 40 and mounting components of the axle assembly 1 of the present invention. The mounting base 40 is provided with holes for accommodating bolts or other fasteners (not shown) to attach the mounting base 40 onto the upper surface of the skateboard 100. As can be seen the mounting base includes an upper surface having a forward section 42 sloping in a rearward direction by a predetermined angle $\beta$ with respect to the horizontal and a rear section 49 sloping in a forward direction, the two sections 42, 49 joining to form an obtuse angle $\alpha$ when viewed from a side view. Upwardly projecting shaft 41 extends upwardly from the mounting base 40 in a direction substantially perpendicular to the front section 42 of the upper surface.

The axle assembly 1 is assembled by initially mounting washer 45 on the upwardly projecting shaft 41. Next, the bracket 13 having the oversized slot hole 14, elastic member 46, and washer 47 are placed on the upwardly projecting shaft 41. Lastly, a fastener (or nut) 48, is screwed down over the threaded end portion at the tip end of upwardly projecting shaft 41. As the bracket 13 is lowered down over the tip end of the upwardly projecting shaft 41, mounting pin 15 is inserted into and held firm by insertion hole 44 of the mounting base 40.

The elastic member 46 allows a right side of the skateboard 100 to tilt downwardly up to a predetermined amount with respect to the axle frame member 10 when turning right, and allowing a left side of the skateboard to tilt downwardly up to a predetermined amount with respect to the axle frame member 10 when turning left.

In addition, when turning the oversized slot hole 14 of bracket 13 allows the pivot bracket 13 to pivot about the mounting pin 15 and move laterally relative to the shaft 41. Front and rear axle assemblies pivot in opposite directions.

FIG. 9 is a top down view of a central portion of the axle assembly of the present invention showing the central arm portions 11R, L and bracket 13 of the axle frame member 10 mounted on the upward projecting shaft 41. Also shown are elastic member 46, washer 47, and threaded fastener 48.

The operation of the axle assembly of the present invention will be described next.

A rider operates the skateboard 100 of the present invention much like one would operate a conventional skateboard. The rider stands on the board in a comfortable position (right foot forward or left foot forward), with body weight evenly distributed on the board. The rider then keeps one foot on the board and pushes with the other foot propelling the skateboard forward, returning the "pushing" foot on board whenever desired. To turn the skateboard, the rider simply leans to the left or right, and the board responds in kind.

With the top-mounted axle assembly 10, comfort of the ride is improved, and stability at slow speeds is enhanced. The turning radius of the skateboard can be changed as well, by either tightening or loosening nut 48. Loosening nut 48 increases the turning radius at slower speeds, but the board becomes less stable at high speeds. Tightening nut 48 decreases the turning radius at slow speeds, but makes the board more stable at high speeds.

While one embodiment of the present invention was described herein with respect to FIGS. 1-9, variations of the inventions of the invention are assumed to be included within the scope of this invention.

While an axle frame member 10 is in the shape of an inverted "W" is shown in the embodiment, other shapes are possible, provided the shape of the axle frame member 10 allows the skateboard upon which the rider stands to be disposed between the wheels. While a standard mounting base 40 is shown, mounting bases of other shapes are possible. While the axle frame member 10 is generally a solid member, a hollow member may be used also, provided rigidity is maintained.

With the top-mounted, wide-track axle assembly of the present invention is mounted on a skateboard, learning to use the skateboard easier, and stability and handling while riding on the skateboard are improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An axle assembly for a skateboard, comprising:

an axle frame member having a length of at least eight inches and formed substantially in a shape of an inverted "W", wherein a central portion of the axle frame member is provided with a mounting bracket having a downwardly projecting pin and a slot-shaped hole for pivotably and tiltably mounting the axle frame member on a top surface of the skateboard in a direction perpendicular to a traveling direction of the skateboard, and wherein outer arm portions provided on right and left ends of the axle frame member include cylindrical-shaped axle mounting portions for accommodating a pair of right and left wheels outboard of side edges of the skateboard, wherein the cylindrical-shaped axle mounting portions are integrally formed in fixed positions on ends of the outboard arm portions, the axle frame member further comprising:

two central arm portions extending upwardly and outwardly, respectively, in a right and a left direction from the central portion of the axle frame member, wherein the central arm portions extend upwardly and outwardly from the central portion of the axle frame member and join to form a "V" having an obtuse angle, and the mounting bracket is fixed to the axle frame member at a bottom of the "V" of the central portion.

2. The axle assembly according to claim 1, wherein the outer arm portions extend, respectively, in a downward direction from ends of the central arm portions; and each of the cylindrical-shaped axle mounting portions includes a hole for accommodating an axle for the wheels.

3. The axle assembly according to claim 1, the mounting bracket of axle frame member is adapted to be pivotably and tiltably connected to a mounting base attached to the top surface of the skateboard.

4. The axle assembly according to claim 3, wherein the downwardly projecting pin of the mounting bracket is adapted to fit into an insertion hole on an rear portion of the mounting.

5. The axle assembly according to claim 3, wherein the slot-shaped hole of the mounting bracket is adapted to receive an upwardly projecting shaft on a forward portion of the mounting base.

6. The axle assembly according to claim 3, further comprising an elastic member and a threaded fastener for attaching the bracket of the axle frame member to the upwardly projecting shaft of the mounting base, the elastic member allowing a right side of the skateboard to tilt downwardly up to a first predetermined amount with respect to the axle frame member when turning right, and allowing a left side of the skateboard to tilt downwardly up to the first predetermined amount with respect to the axle frame member when turning left.

7. The axle assembly according to claim 1, wherein the outer arm portions extend downwardly further than the central portion of the axle frame member.

8. An axle assembly for a skateboard, comprising:

an axle frame member having a length of at least eight inches and having a downward facing dip in a central portion thereof, wherein a lower side of the central portion of the axle frame member is provided with a mounting bracket having a downwardly projecting pin and a slot-shaped hole for pivotably and tiltably mounting the axle frame member on a top surface of the skateboard in a direction perpendicular to a traveling direction of the skateboard, and wherein outer arm portions are provided on opposite ends of the axle frame member for accommodating a pair of right and left wheels outboard of side edges of the skateboard, wherein the axle frame member includes:

two central arm portions extending upwardly and outwardly, respectively, outwardly and upwardly from the central portion of the axle frame member, the two central arm portions joining to form a "V" having an obtuse angle, wherein the mounting bracket is fixed to the axle frame member at a bottom of the "V" having an obtuse angle.

9. The axle assembly according to claim 8, wherein the axle frame member includes:

the outboard arm portions extend, respectively, in a downward direction from ends of the central arm portions; and cylindrical-shaped axle mounting portions integrally formed on ends of the outboard arm portions, each of the cylindrical-shaped axle mounting portions having a hole for accommodating an axle for the wheels.

10. The axle assembly according to claim 8, the mounting bracket of axle frame member is adapted to be pivotably and tiltably connected to a mounting base attached to the top surface of the skateboard.

11. The axle assembly according to claim 10, wherein the downwardly projecting pin of the mounting bracket is adapted to fit into an insertion hole on an rear portion of the mounting.

12. The axle assembly according to claim 10, wherein the slot-shaped hole of the mounting bracket is adapted to receive an upwardly projecting shaft on a forward portion of the mounting base.

13. The axle assembly according to claim 10, further comprising an elastic member and a threaded fastener for attaching the bracket of the axle frame member to the upwardly projecting shaft of the mounting base, the elastic member allowing a right side of the skateboard to tilt downwardly up to a first predetermined amount with respect to the axle frame member when turning right, and allowing a left side of the skateboard to tilt downwardly up to the first predetermined amount with respect to the axle frame member when turning left.

14. The axle assembly according to claim 8, wherein the outer arm portions extend downwardly further than the central portion of the axle frame member.

15. An axle assembly for a skateboard, comprising:

an axle frame member formed substantially in a shape of an inverted "W", wherein a central portion of the axle frame member is provided with a mounting bracket having a downwardly projecting pin and a slot-shaped hole for pivotably and tiltably mounting the axle frame member on a top surface of the skateboard in a direction perpendicular to a traveling direction of the skateboard, and wherein outer arm portions provided on right and left ends of the axle frame member include cylindrical-shaped axle mounting portions for accommodating a pair of right and left wheels outboard of side edges of the skateboard, wherein cylindrical-shaped axle mounting portions remain coaxial with respect to each other during turning of the skateboard, the axle frame member further comprising:

two central arm portions extending upwardly and outwardly, respectively, in a right and a left direction from the central portion of the axle frame member, wherein the central arm portions extend upwardly and outwardly from the central portion of the axle frame member and join to form a "V" having an obtuse angle, and the mounting bracket is fixed to the axle frame member at a bottom of the "V" of the central portion.

* * * * *